United States Patent [19]

Reinhold

[11] Patent Number: 4,899,354

[45] Date of Patent: Feb. 6, 1990

[54] ROENTGEN LITHOGRAPHY METHOD AND APPARATUS

[75] Inventor: Albert Reinhold, Wunstorf, Fed. Rep. of Germany

[73] Assignee: Feinfocus Rontgensysteme GmbH, Wunstorf, Fed. Rep. of Germany

[21] Appl. No.: 3,192

[22] Filed: Jan. 14, 1987

Related U.S. Application Data

[63] Continuation-in-part of Ser. No. 644,212, Aug. 24, 1984.

[51] Int. Cl.[4] ..... G21K 5/00

[52] U.S. Cl. ..... 378/34; 378/113; 378/124; 378/137; 378/140; 378/143

[58] Field of Search ..... 378/34–35, 378/113, 121, 122, 124, 136–138, 140, 143; 250/396 R, 398

[56] References Cited

U.S. PATENT DOCUMENTS

| | | | |
|---|---|---|---|
| 2,379,397 | 6/1945 | Zunick | 378/143 |
| 3,158,745 | 11/1964 | Stanhope | 378/137 |
| 3,178,578 | 4/1965 | Gale | 378/137 |
| 3,743,842 | 7/1973 | Smith et al. | 378/34 |
| 3,949,228 | 4/1976 | Ryan | 250/398 |
| 4,007,375 | 2/1977 | Albert | 378/124 |
| 4,048,496 | 9/1977 | Albert | 378/113 |
| 4,153,843 | 5/1979 | Pease | 250/396 R |
| 4,159,436 | 6/1979 | Ely | 378/135 |
| 4,182,955 | 1/1980 | Davis | 378/113 |
| 4,392,054 | 7/1983 | Sato et al. | 250/396 R |
| 4,573,186 | 2/1986 | Reinhold | 378/138 |

*Primary Examiner*—Craig E. Church
*Assistant Examiner*—John C. Freeman
*Attorney, Agent, or Firm*—Robert E. Burns; Emmanuel J. Lobato

[57] ABSTRACT

Roentgen lithography aparatus comprises a roentgen tube for producing long wave roentgen radiation for forming an image of a mask on a substrate. The roentgen tube comprises an electron gun having a glow cathode and a grid, electron beam deflecting and focussing coils, a target on which the electron beam is projected and an exit window through which roentgen rays from the target are projected through a lithography mask onto a substrate. The glow cathode and the target are of high atomic number high melting point material, such as tunsten. The grip has an annular flange with a central opening in which the tip of the glow cathode is disposed. The front face of the flange facing the target is frustoconical with an included angle of about 100° to 140° while the rear face is plane. The angle between the front and rear faces as measured in a radial plane is about 15° to 60°. The focussing coil focusses the electron beam into a focal spot on the target having a diameter less than $10^{-4}$ m. The distance between the target and the exit window does not exceed $2\times10^{-2}$ m and the distance between the target and the lithography mask does not exceed $2\times10^{-1}$ m. The roentgen tube may be provided with a plurality of exit windows in which case the face of the target facing the cathode is dome or polyhedron shaped and the focussing and deflecting coils are controlled to focus the electron beam successively on different points on the target to project roentgen rays out through different windows.

14 Claims, 5 Drawing Sheets

ROENTGEN LITHOGRAPHY METHOD AND APPARATUS

PRIOR APPLICATION

This application is a Continuation-in-Part of my application Ser. No. 644,212 filed August 24, 1984 and now abondoned.

FIELD OF INVENTION

The invention relates to roentgen lithography method and apparatus comprising a roentgen tube for producing long wave roentgen radiation which has an electron gun comprising a glow cathode and a grid, deflecting and focussing means, a target of a material having a high atomic number and a high melting point, a carrier for a substrate to be illuminated by the roentgen rays as well as a carrier for a lithography mask.

BACKGROUND OF INVENTION

Such a roentgen lithography apparatus has been built more than five years ago as an experimental apparatus. This is described in DE-OS 25 54 693. As a target material tungsten was used, a material of high atomic number and high melting point. In the electron gun there was a glow cathode comprising a tungsten filament. With this roentgen tube there was produced long wave roentgen radiation which is especially suitable for roentgen lithography, because like the visible and ultraviolet light used up to now, it is absorbed or reflected by selected areas of the usual lithographic masks. These masks are usually provided with thin layer of gold which is able to absorb and to reflect such radiation.

Such roentgen lithography apparatus has not displaced from the market lithography apparatus working with light, although lithography apparatus working with light has very serious disadvantages, in particular a very long exposure time. This lithography apparatus is used in the production of integrated circuits, in particular high integrated and ultra-high integrated circuits. Through the enormous improvement in the use of electronic switching in all technical areas in particular for the control and computation of technical processes, there is an enormous need for simple and rapid production of such integrated circuits. Hence the technique has sought for many years a possibility of making sharp copies of the finest structure in the submicrometer range by means of roentgen rays. From theoretical considerations roentgen rays are especially suitable for this but in practice there has not yet been produced apparatus which safely and dependably can accomplish the required sharp copies in lithography apparatus.

Compared with light optical processes, roentgen processes have the physical advantage that even in the order of magnitude smaller than $\mu$m, roentgen ray diffraction and interference are negligible and that consequently in the sub-micrometer region precise silhouettes are to be expected of interposed masks. Dirt and dust play a much lesser role with roentgen rays than with light projection. In contrast with electron optical processes, external electrical interference fields can be neglected.

Because hard roentgen rays can penetrate lithography masks practically unhindered, it is necessary for the production of high contrast images to use weak roentgen rays produced with a voltage from 3 to 25 KV. However with roentgen (retarded-) rays the efficiency of the roentgen ray output is extremely limited. This leads to long exposure time.

On account of these unsuccessful endeavers to work with roentgen retarded rays in lithography, research was undertaken to produce roentgen rays in sufficient yield with the help of a synchroton and novel plasma sources. However because of the high purchase price of a synchroton, the very high operating cost and very great amount of space required for installation of a synchroton, the use of synchrotons for lithography is never commercially economic. Novel plasma sources, on the other hand, are not yet out of the experimental field and are probably scarcely usable on account of the very extensive safety precautions required.

Even positron storage rings have been tried experimentally for roentgen lithography. However these endeavors have not proceeded beyond the experimental state.

There thus remains the problem of creating operational roentgen lithography apparatus.

SUMMARY OF THE INVENTION

The present invention proceeds from the recognition that to achieve such operational roentgen lithography apparatus, measures must be taken ahead of the target to produce effectively and economically the required long wave roentgen radiation and that, on the other hand, on the target itself and behind the target measures are necessary for effective radiation and thus for short exposure time.

It is an object of the invention to provide operational and efficient roentgen lithography apparatus which with limited energy requirements and simple construction produces sufficient long wave roentgen radiation that relatively short exposure times are made possible.

Roentgen lithography apparatus in accordance with the present invention comprises a roentgen tube for producing long wave roentgen radiation for forming an image of a mask on a substrate. The roentgen tube comprises an electron gun having a glow cathode and a grid, electron beam deflecting and focussing means for focussing an electron beam on a target and an exit window through roentgen rays produced on the target are projected through a lithography mask in a mask holder onto a substrate in a substrate holder. The grid comprises an annular flange having a central opening in which a tip portion of the cathode is disposed. A front face of the flange facing the target is frustroconical with an included angle from approximately 100° to 140°. The front and rear surfaces of the flange converge toward the central opening at an angle of 15° to 60° measured in a radial plane. The focussing means focusses the electron beam on the target in a focal spot having a diameter of less than $10^{-4}$ m. The distance between the target and the exit window of the roentgen tube does not exceed $2\times10^{-2}$ m and the distance between the target and the lithography mask does not exceed $2\times10^{-1}$ m.

The electron gun used produces on an especially small focus an especially intense electron stream which by reason of the small focus is well concentrated, but through electron focussing means can be further concentrated so that on the target there results an especially small focal spot on which, however, as an acceleration voltage of 3 KV to 25 KV is used, very intensive long wave roentgen radiation is produced. Through the matching of the accelerating voltage for the electron stream with the target material of high atomic number and high melting point in the manner that a calculated voltage is used which assures that the greatest part of the electrons of the electron stream are arrested in the outermost atomic layers of the target, it is assured that intensive long wave radiation will be produced. The intensive strongly focussed electron stream works together with the atoms of the target in the manner that with the mutually interfering electrons of the electron stream, a deflection, which is the rule with less concentrated and not so intensive electron streams, cannot occur. Thus through a roentgen tube with an extremely small glow emission spot, electrical means for reducing the image of the glow emission spot on the target, a target of a material of high atomic number and a high melting point, e.g. tungsten, and a focal spot on the target with a diameter of less than $10^{-4}$ m already in the region of the target and on the target, the prerequisities for effective roentgen lithography are created. Through the selection of an unusually small distance between the target and the window and between the target and the lithography mask these favorable results are further improved.

Through a such small focal spot on the target, the target is naturally highly stressed. Therefore it is advantageous when the surface of the target is arched or consists of at least two plane faces arranged at an angle to one another and separated by an edge, when a part of the arched surface or one of the plane surfaces is turned toward one roentgen ray exit window and another part of the arched surface or another plane surface is turned toward another roentgen ray exit window, when the target angle for the rays emerging through each window of the roentgen tube is so selected that it lies between 0° and 10°, advantageously about 5.5°, and when there is provided a control device for the voltage fed to the deflection device by which the electron stream in shifting from one radiation point to another radiation point is deflected twice over the zenith of the target surface turned toward the electron gun or one of the edges of the target surface turned toward the electron gun. In this manner there is attained a continual focal spot change, namely pulsed operation of the roentgen tube, whereby however the roentgen tube remains constantly in operation so that no disadvantage through on and off switching of the electron stream can occur.

In this pulsed operation it is advantageous when the impingment point of the electron beam is allowed to dwell on one focal point and then the electron beam is moved rapidly to the next focal point and is there again allowed to dwell because then the times in which the image and electron stream is utilized are greater than the times in which the electron stream is not utilized.

It is especially efficacious for the utilization of the electron stream when the roentgen tube has at least two roentgen ray exit windows at opposite sides between which the target is arranged, when the surface of the target facing the cathode is arched with its zenith turned toward the electron gun or consists of plane faces arranged at an angle to one another with at least one edge separating them, when on both sides of the zenith there is a part of the arched surface or on both sides of the edge there is a flat surface turned toward a roentgen ray exit window, when for the rays exiting through each of the exit windows of the roentgen tube there is selected a target angle that lies between 0° and 10°, preferably about 5.5°, and when there is provided a control device for the voltage fed to the electron beam deflecting device with which the electron beam, upon displacement from one reflection point on one surface (or surface part) to another reflection point on the other surface (or surface point), is deflected over the zenith or over the edge. In this manner there is provided roentgen lithography apparatus which has on both sides of the roentgen tube a carrier for the lithography mask and a carrier for the substrate that is to be illuminated. Thus a substrate arranged on one side of the roentgen tube and a substrate arranged on an another side of the roentgen tube are alternately illuminated so that the electron stream of the roentgen tube is continuously used. Not only is the continuous use of the electron stream of the roentgen tube a particular advantage, but there is also the further advantage that during the time in which one substrate is not illuminated this substrate can be replaced by a wholly unilluminated substrate. During this replacement time the substrate at the other side of the roentgen tube is illuminated.

BRIEF DESCRIPTION OF DRAWINGS

The major objects and advantages of the invention will be more fully understood from the following description in conjunction with the accompanying drawings which illustrate schematically preferred embodiments of the invention. In the drawings.

DESCRIPTION OF PREFERRED EMBODIMENTS

Figure 1:
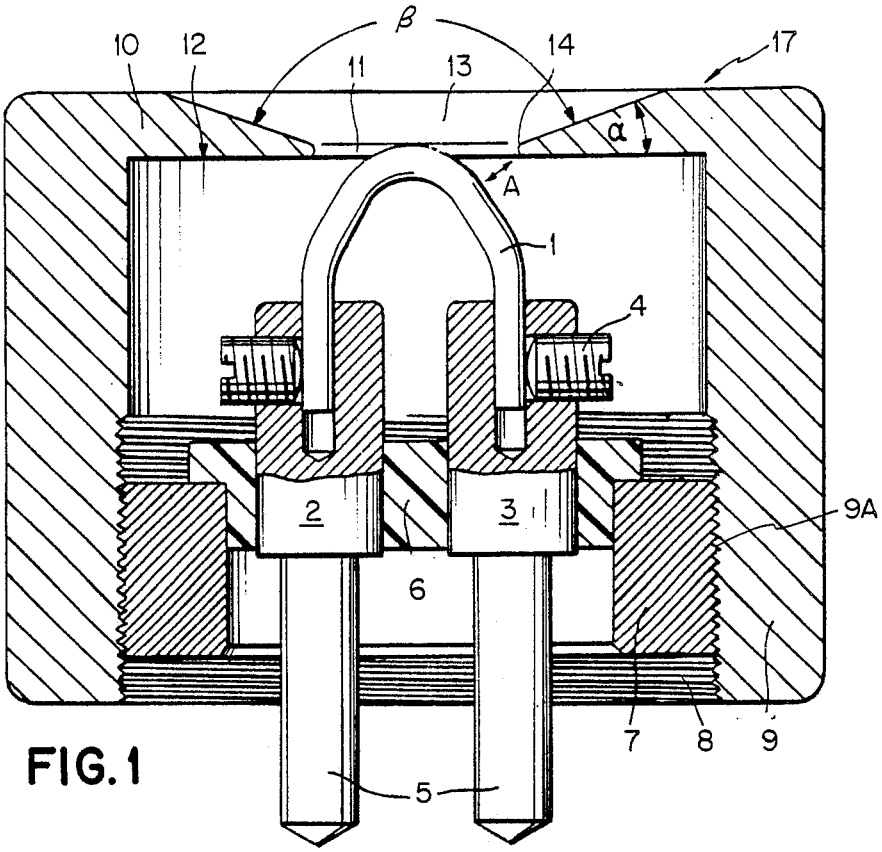
FIG. 1 is an axial section through an electron gun with a very small emission spot and high electron emission.

For the present invention, it is highly important to use an electron gun with a glow cathode of which the electron emitting area has the smallest possible diameter. Such an electron gun is illustrated in FIG. 1.

The shanks of the U-form bent hot fillament 1 of the glow cathode are clamped in clamping devices 2, 3 by means of screws 4. The clamping devices 2, 3 end in terminal pins 5 which plug into a source of electrical current. The two clamping devices 2, 3 are set in an insulating disc 6 mounted in a ring 7 which is externally threaded and is screwed into an internally threaded end portion of a cylindrical part 9A of a cup-shaped grid 9. The grid 9 and the glow cathode 1 thus form a structural entity which can be plugged into a socket by means of the terminal pins 5. Moreover by screwing the ring 7 in or out of the threaded portion of the grid 9 the position of the grid with respect to the glow cathode 1 can be varied. At the end opposite the internally threaded end of the cylindrical part 9A, the grid has an inwardly directed flange 10 having a central opening 11 which surrounds the tip of the hot filament 1 serving as the glow cathode. The inner side 12 of the flange 10 facing the glow cathode is either plane (FIG. 1) or inclined in a direction toward the glow cathode 1 so that the angle between the inner face 12 of the flange 10 and the inner surface of the cylindrical part 9A of the grid 9 is less than 90°. The outer side 13 of the flange 10 which faces the target of the roentgen tube is formed conical or funnel shaped in such manner that the flange 10 tapers toward the central opening 11. The center of this funnel shaped surface 13 is located in the tip of the glow filament 1 or slightly below the tip of the glow filament. The surface 12 is likewise directed on the tip of the glow filament 1 or a point slightly below the tip of the glow filament 1. The edge 14 of the central opening in the flange 10 and thus the convergence of the funnel shaped surface 13 and the surface 12 is rounded and indeed is approximately semi-circular in cross section. The radius of this half circle is small.

The cathode comprises a filament of which the diameter is preferably between 0.2 and 0.4 mm. The distance A from the edge 14 of the central opening of the flange 10 of the grid 9 to the closest portion of the glow filament 1 is preferably between 0.4 and 4 mm. The angle $\alpha$ which is the angle between the conical outer surface 13 and the inner surface 12 of the flange as measured in radial section is preferably between 15° and 60° while the angle $\beta$ which is the cone or funnel angle of the conical surface 13 of the flange is preferably between 100° and 140°.

Figure 2:
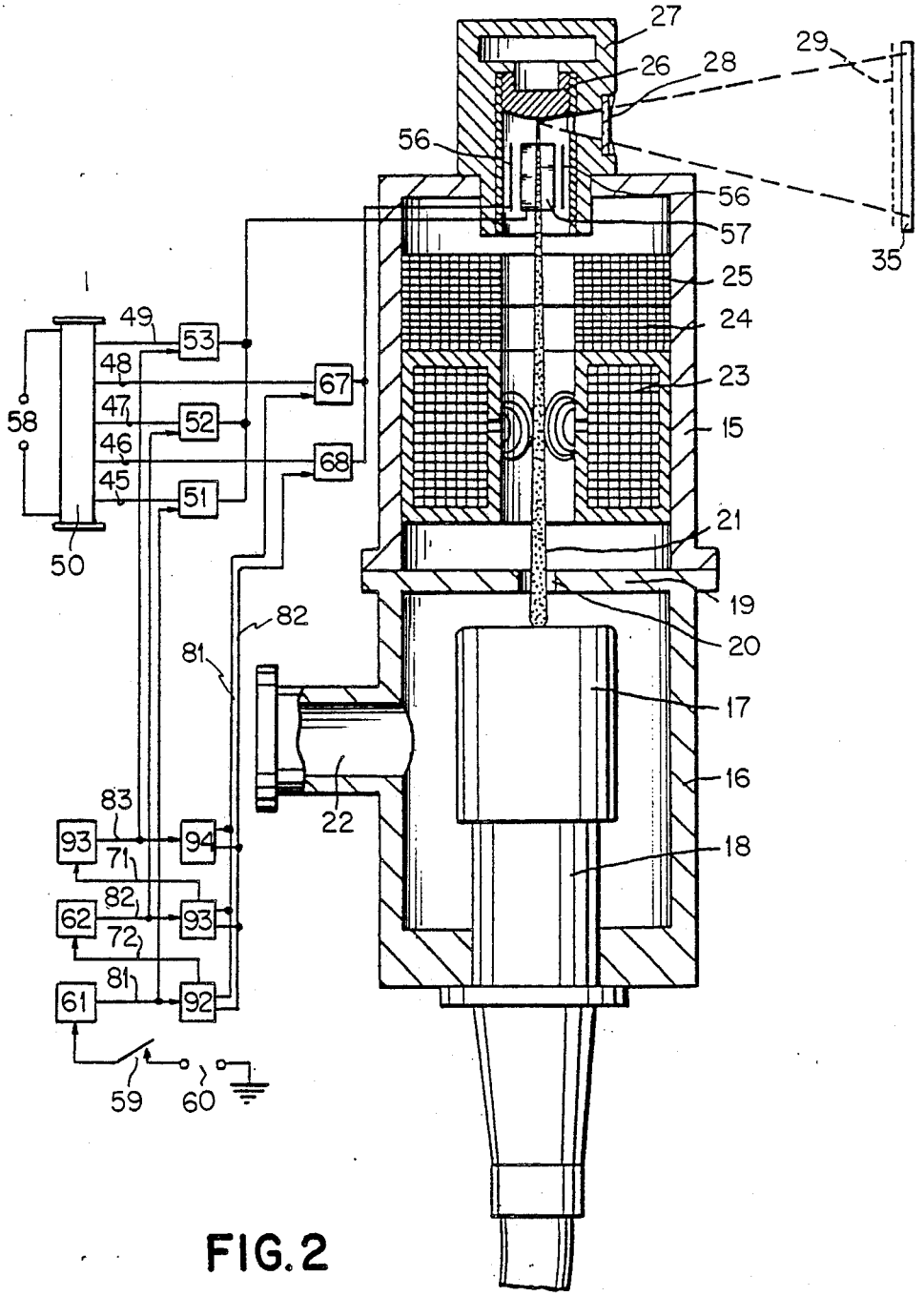
FIG. 2 is an axial section through roentgen lithography apparatus in accordance with invention and a circuit diagram of control circuitry.

The roentgen lithography apparatus as shown in FIG. 2 comprises a roentgen tube with a two-part housing 15, 16 in which the electron gun 17 shown in axial section in FIG. 1 is installed. The electron gun 17 is plugged into a socket 18 by means of the two terminal pins 5. The housing is divided by a partition 19 having a central opening 20 for passage of the electron stream 21. On the housing part 16 which carries an evacuation nipple 22 for evacuating the entire roentgen tube, a forward housing part 15 is flanged. In the housing part 15 are installed deflection and focussing coils 23,24 and 25 and in an end opening there is removably mounted a housing part 27 for the target 26. The housing part 27 has an exit window 28 for roentgen rays produced on the target 26. In the radiation field of the exit window 28, there are arranged a carrier with a lithography mask 29 as well as a carrier with a substrate 35 which is to be illuminated. The substrate is for example a chip for integrated circuitry.

Figure 3:
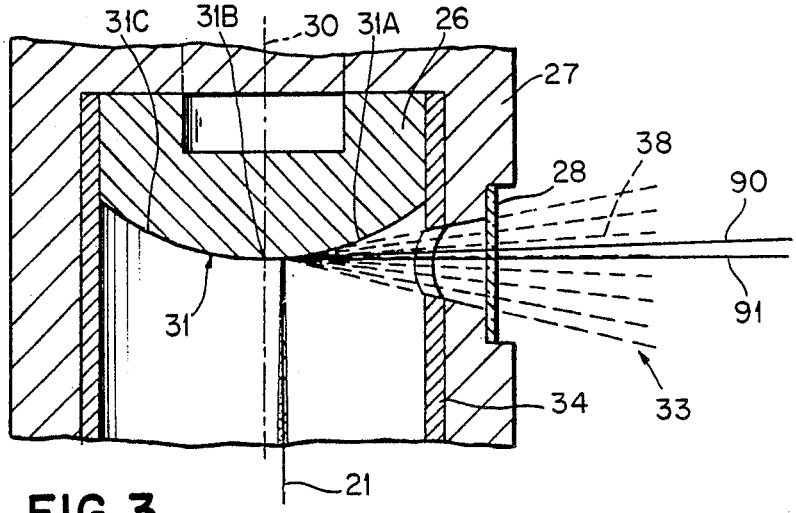
FIG. 3 is an axial section on a larger scale through the roentgen tube in the region of the target.

In FIG. 3 there is shown an enlarged axial section through the housing part 27 with the target 26. A dot dash line 30 lies in the geometric center of the roentgen tube and passes through the zenith of the dome-shaped surface 31 of the target 26. The electron stream 21 is displaced relative to the line 30 and falls on the surface 31 of the target 26 to produce roentgen rays 33 which pass out through window 28 with a target angle of less than 10° and preferably about 5.5°. As illustrated in FIG. 3, the target angle is the angle between line 90 which is tangent to the surface of the target at the impingement point of the electron beam and line 91 which is perpendicular to the electron beam 21. The inner space of the housing part 27 is provided with a roentgen ray absorbing covering 34. In this roentgen tube the electron stream 21 can be deflected through electronic deflection from the surface part 31A, over the Zenith 31B, to a second surface part 31C from which roentgen rays there produced do not emerge from the exit window. This change avoids damage of the target through overheating in a localized spot. In order for a radiation point, for example in the plane of the paper, to proceed to another point which is in front of or behind the plane of the paper, it is necessary for the electron stream to pass over the zenith 36B twice and to pass from one radiation point to the next over a path on the side of the target turned away from the window 28. A blurring effect on the substrate is thereby avoided.

Figure 4:
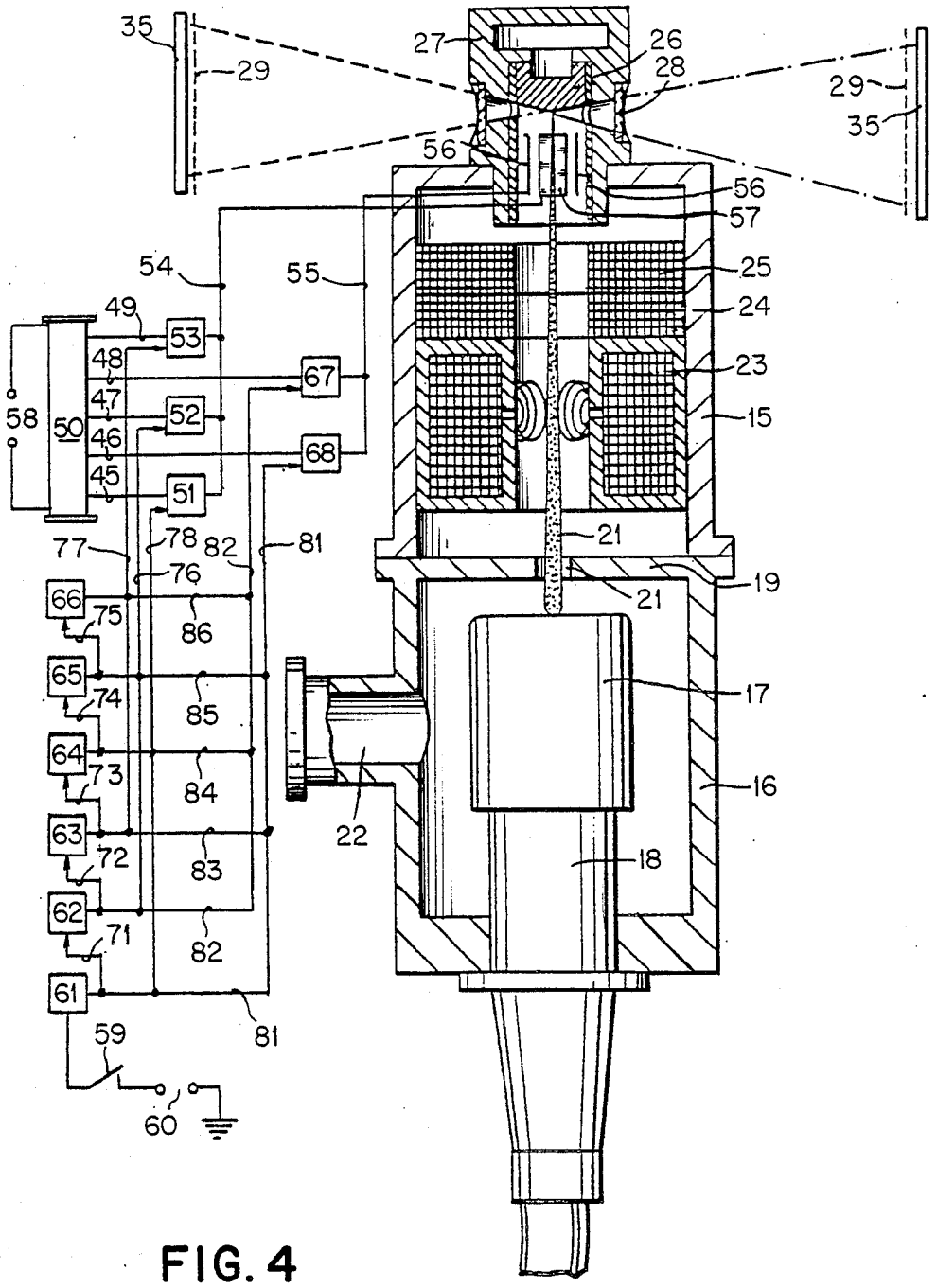
FIG. 4 is an axial section through roentgen lithography apparatus for the alternate illumination of two substrates and a circuit diagram of control circuitry.
Figure 5:
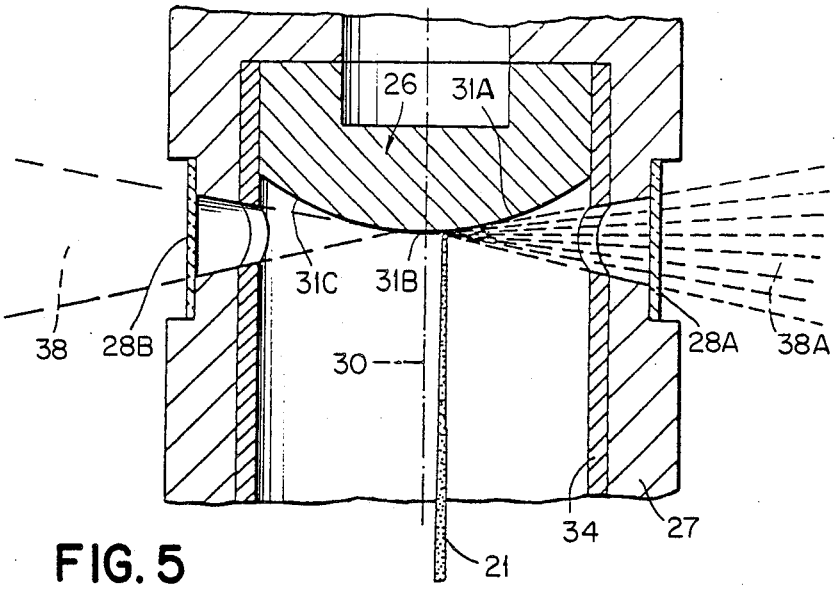
FIG. 5 is a axial section on a larger scale of the target region of the roentgen tube of the apparatus of FIG. 4.

This domed formation of the target and the deflection of the electron stream from one target surface 31A to another target surface 31C can also be used for alternately illuminating two substrates 35 with roentgen radiation by pulsed operation. An apparatus suitable for this is illustrated in FIG. 4. The apparatus shown in FIG. 4 is of the same construction as that of FIG. 2 except that on opposite sides of the housing part 27 there are carriers for lithography masks 29 and carriers for a substrate 35. Moreover, the housing part 27 has not a single exit window 28, but rather two exit windows 28A and 28B as is also seen in FIG. 5.

Figure 6:
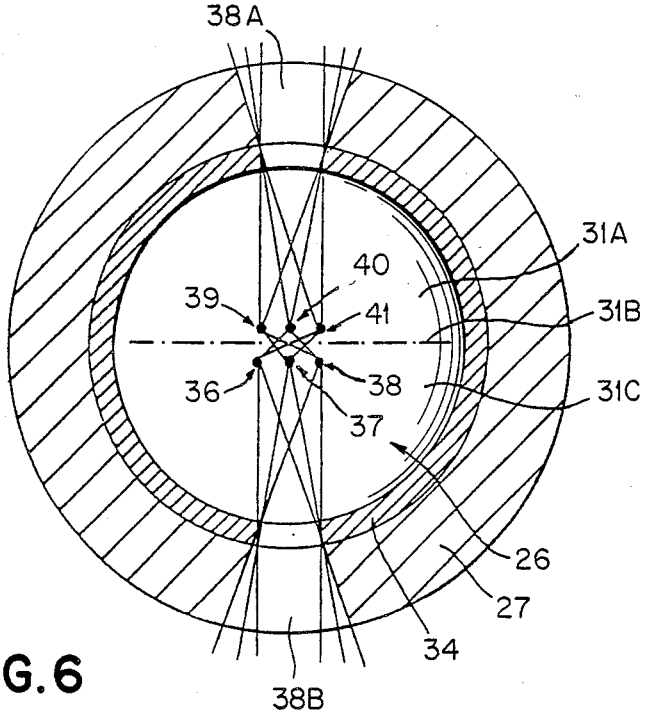
FIG. 6 is a cross section through the roentgen tube of the embodiment of FIG. 4 below the target with a schematic illustration of the focal spots on the target.

FIG. 6 is a cross section through the housing part 27 showing the target 26. On both sides of the zenith 31 there are arranged three radiation points 36,37 and 38 on the surface part 31A and 39,40,41 on the surface part 31C. As indicated by the arrow lines, the radiation point moves from point 36 to point 40 then to radiation point 38, then to radiation point 39, then to radiation 37, then to radiation point 41 and from there back to radiation point 36. By each of these movements from one radiation point to another the zenith 31B is crossed. Each of the two substrates 35 will thus be illuminated for a predetermined time and will then be interchanged with an unexposed substrate when the roentgen rays are directed to another substrate and thereafter the unexposed substrate will be illuminated from another spot of the same target surface. In the illustrated embodiment six substrates are illuminated before the cycle repeats for the next six substrates.

An impulse pause can be used for replacing a sufficiently exposed substrate by an unexposed substrate. In this manner the roentgen tube is in continual operation without out-of-action time.

For the production of the desired long wave roentgen radiation, an acceleration voltage of from 3 to 25 KV and a target of tungsten are used. Through a computation, the accelerating voltage is selected so that the retardation of the electrons occurs in the outermost atomic layers of the target. Thus almost the entire electron stream is retarded soley in the outermost atomic layers.

Figure 7:
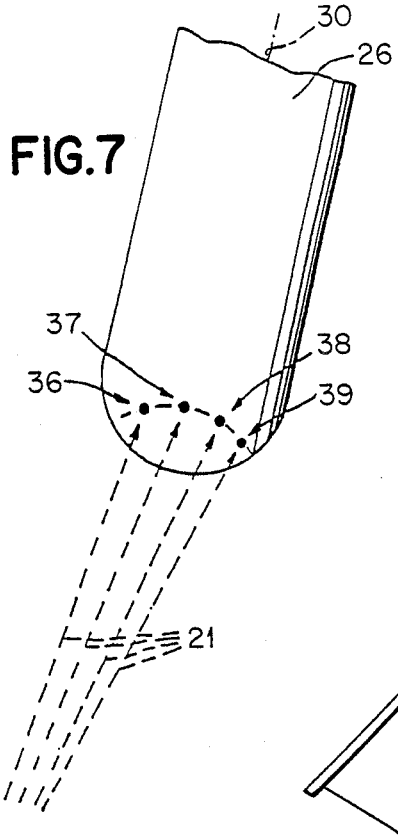
FIG. 7 is a schematic perspective view of a semispherical target.
Figure 9:
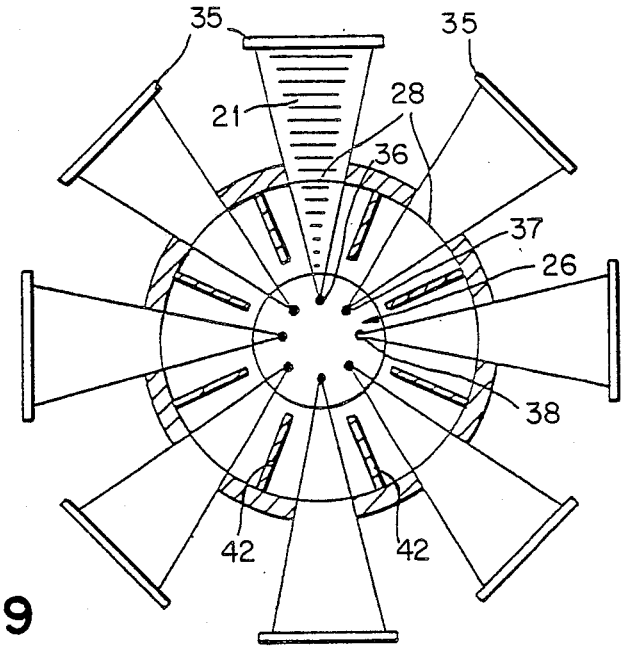
FIG. 9 is a schematic illustration of the arrangement around the roentgen tube of a plurality of substrates to be illumination.

FIG. 7 shows a domed target which has a radiation surface in the form of a hemisphere. From the radiation points 36, 37, 38, 39 (and the radiation points 40, 41 not shown in FIG. 7) roentgen radiation is emitted in six directions which lie in radial planes to the geometric axis of the target 26. The electron beam 21 is thereby moved step-by step from one radiation point to the next radiation point and then always remains a certain time on each radiation point. With this embodiment, the substrates 35 to be exposed to the roentgen radiation are arranged radially about the geometric axis 30 of the target as shown by way of example in FIG. 9. Here eight radiation points are provided on the target on which the electron beam 21 is deflected electromagnetically and eight corresponding exit windows 28 are provided through which the roentgen radiation 33 is emitted. Between the individual exit windows 28 absorbtion shields 42 are provided to prevent the undesired emission of roentgen rays out of adjacent exit windows. The substrates 35 are arranged in a circle around the geometric axis 30, special holders being provided for the substrates. Other holders hold lithography masks 29 in front of the substrates.

Figure 8:
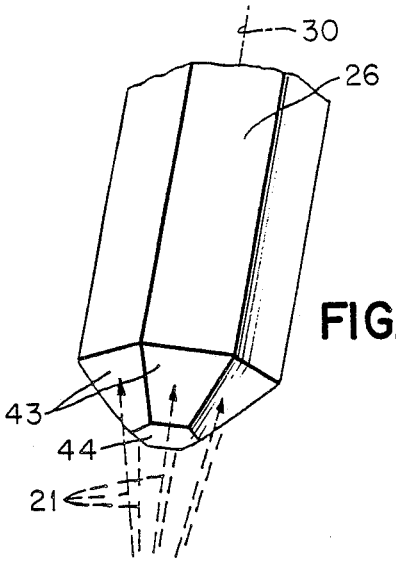
FIG. 8 is a schematic perspective view of a truncated pyramid target.

In FIG. 8 is shown another possible target form which has six plane faces 43 on which the electron stream 21 is directed and on these faces the radiation points 36 to 41 are formed. Here the target is formed as a truncated pyramid in the middle of which there is a plane face 44 which is separated by edges from the faces 43 and which lies perpendicular to the geometric axis of the target.

Naturally the number of radiation points and the number of radiation surfaces 43 need not be an even number since also an uneven number of faces and radiation points is possible. When external spacial conditions make it necessary it is also not necessary for the substrates to be arranged in a circle around the roentgen tube. They can also be arranged in a partial circle. This arrangement of several substrates to be illuminated in the use of a single target for the illumination of different substrates through different exit windows in different locations is not dependant on the electron gun shown in FIG. 1, provided that the electron gun used directs a sufficiently sharply focussed electron beam of sufficiently high intensity on the target.

In accordance with the present invention, the electron beam is controlled so as to fall successively on a plurality of radiation points with a dwell for a predetermined period of time on each radiation point and rapid shifting from one radiation to another, the dwell time on each radiation point being sufficiently short to avoid damage to the target by the sharply focused electron beam. Circuitry for controlling the electron beam to shift from one radiation point to another as illustrated in FIG. 6 is shown by way of example in FIG. 4.

The jumping of the electron beam from one impingement point to the next is accomplished through two pairs of deflection plates 56,57 which are arranged perpendicular to one another about the path of the electron beam 21. The plates 57 are arranged parallel to the plane of the paper and control the electron beam to position the electron beam in the middle of the target on radiation points 37,40 or to the left thereof on radiation points 36,39 or to the right thereof on radiation points 38,41 (FIG. 6). The deflection plates 56, on the other hand, control the electron beam to position the electron beam forwardly on the target on radiation points 36,37,38 or rearwardly on the radiation points 39,40,41. This is achieved by applying different voltages to the pairs of deflection plates 56,57.

Voltage is supplied to the deflection plates 56,57 by a voltage source 58 on which is provided a potentiometer 50 with five different taps supplying different voltages to gate circuits 51,52,53,67 and 68. When one of the gates 51,52,53 is open, the other two are closed. When one of the gates 67,68 is open, the other is closed. In particular, the six different radiation points illustrated in FIG. 6 are realized in the following manner:

Radiation point 36: Gates 51,68 are open
Radiation point 37: Gates 52,68 are open
Radiation point 38: Gates 53,68 are open
Radiation point 39: Gates 51,67 are open
Radiation point 40: Gates 52,67 are open
Radiation point 41: Gates 53,67 are open The other gate circuits are closed so that electrical line 54 supplies to deflection plates 57 the voltage of tap 45,47 or 49 while electrical line 55 supplies to deflection plate 56 the voltage of tap 46 or 48.

The gate circuits 51,52,53,67 and 68 are opened by means of control circuits 61 to 66 comprising timing elements. The control circuit 61 receives an initial impulse from a voltage source 60 through actuation of switch 59.

Each of the control circuits 61 to 66 is so constructed that upon the disappearance of a voltage at its input, there is produced a pulse which appears as a voltage at the output of the control circuit and which simultaneously sets a timing element in operation. At the end of an adjusted preset time period, the voltage at the output disappears. The voltages at the outputs of the control circuits 61 to 66 are transmitted by the electrical lines 81 to 86 to gate circuits 67,68 and by connecting electrical lines 76 to 78 to gate circuits 51 to 53. Moreover, electrical lines 71 to 75 connect each of the control circuits 61 to 65 with the chronologically following control circuit 62 to 66.

In particular, these control circuits function as follows:

Through the opening of the switch 59, the voltage from the voltage source on the input of the control circuit 61 disappears so that in the control circuit 61 there is produced a pulse which appears as a voltage at the output of the control circuit 61 and hence in lines 81,78 and 71 for a predetermined time period. The time period is determined by the timing element of the control circuit 61. Through the voltage in lines 81,78 the gates 68 and 51 are opened so that the voltage of lines 46,45 are applied to deflection plates 56,57 whereby the electron beam is directed to point 36 (FIG. 6). With the switching off of the voltage at the output of control circuit 61 through the timing element in control circuit 61 the gates 68,51 are closed.

Simultaneously, through the voltage drop in line 71 control circuit 62 is activated and operates in like manner to open gates 67 and 52 to apply the voltage of line 48 to plate 56 and the voltage of line 47 to plates 57, whereby the electron beam is shifted to point 40. When the timing element switches off the voltage at the output of control circuit 63, the gates 67, 52 are closed.

Simultaneously, through the voltage drop in line 72 connected with line 82 in the input circuit of control circuit 63, there is produced a pulse which sets the timing element in the control circuit 63 into action and produces at the output of the control circuit 63 a voltage which is transmitted over line 83 of line 81 to open the gage 68 and over line 67 to open gate 53. On the deflection plates 57, there is now applied the voltage of line 46 and on the deflection plates 56, there is applied the voltage of line 45. Thereby the electron beam is shifted to radiation point 38. As soon as the timing element in the control circuit 63 switches off the voltage at the output of the control circuit 63, the gates 68,53 are closed.

Simultaneously, through the voltage drop in line 73 connected with line 83 in the input circuit of the control circuit 64, there is produced a pulse which sets the timing element of the control circuit 64 into operation and produces at the output of the control circuit 64, a voltage which is transmitted to line 84 on one hand to line 82 and on the other hand to line 78 for opening of gates 51,67. Thereby, the electron beam is shifted to the radiation point 39. Upon disappearance of voltage from the output of the control circuit 64, the control circuit 65 is set into operation and thereby gates 68 and 52 are opened whereby the electron beam is shifted to the radiation point 37.

Through the disappearance of voltage at the output of the control circuit 65 connected with the closing of the respective gates, the control circuit 66 is put into operation whereby gates 67,53 are opened and electron beam is directed to radiation point 41.

The control circuitry shown in FIG. 2 is constructed somewhat differently.

The gates 67,68 are opened and closed through control circuits 92,93,94. Each of the control circuits 92,93 and 94 has two outputs which are known from the switching of bistable multivibrators having two coupled transistors. With a bistable multivibrator one or the other transistor draws current, a control pulse being given by the transistor which does not draw current so that this transistor becomes conductive while simultaneously the current flow through the other transistor is switched off. This switching of the bistable multivibrator from one position to another follows a certain time pattern whereby the bistable multivibrator comprises a timing element. The two outputs of each of the bistable multivibrators are connected with lines 81,82 which leads to gates 67,68. A third output technically identical with one of the two outputs of the bistable multivibrator leads over lines 71,72 to succeeding control circuits 62,63 which are identical with those of FIG. 4.

This control circuits works in the following manner:

Upon the opening of the switch 59, the control circuit 61 is put into operation and there appears at the output a voltage which is led to the gate 51 to open the gate. This voltage is also led to the control circuit 92 which first applies a voltage to line 81 to open gate 67 and then, after a predetermined adjustable time period, this voltage disappears and there is produced on line 82 a voltage which then opens gate 68. Upon disappearance of voltage on line 81, the voltages of both outputs of control circuit 92 disappears. Also, the voltage on line 72 disappears so that control circuit 62 is put into operation and produces on line 82 voltage that opens gate 52 and simultaneously sets the control circuit 93 into operation. First gate 67 and then gate 68 are successively opened until by disappearance of voltage on the line 82, the control circuit 63 is put into operation over line 71. Control circuit 94 is thereupon put into operation so that upon opening of gate 53, first gate 67 and finally gate 68 are opened until the voltage on line 83 disappears. With this operation, the impingement point of the electron beam in FIGS. 6 shifts from 36 to 39 to 27 to 40 to 41.

Other circuitry is usable, the two shown in FIG. 2 and FIG. 4 being only by way of example.

What I claim is:

1. Roentgen lithography apparatus comprising a roentgen tube for producing long wave roentgen radiation comprising an electron gun having a glow cathode and a grid, electron beam acceleration and focussing means for producing a continuous electron beam, a stationary target on which said electron beam is projected and at least two exit windows through which roentgen rays produced on said target are projected through lithography masks in mask holders onto substrates in substrate holders respectfully, said grid comprising a cylindrical body portion having at its forward and facing said target an annular flange having a central opening in which a tip portion of said cathode is disposed, a front surface of said flange facing said target being frustoconical with an included angle of from approximately 100° to 140° and the front and rear surfaces of said flange converging toward said central opening at an angle of 15° to 60° measured in a radial plane, radial inward projections of said front surface and said rear surface of said flange converging in said tip portion of said cathode, said electron beam accelerating means comprising means for applying to said beam an acceleration voltage of 3 KV to 25 KV, said focussing means sharply focussing said electron beam into a focal spot on said target having a diameter less than $10^{-4}$ m., said target being of material of high atomic number and high melting point, the distance between the target and the exit window of the roentgen tube not exceeding $2\times10^{-2}$ m. and the distance between the target and the lithography mask not exceeding $2\times10^{-1}$ m., said target having a plurality of radiation surface areas which are all of identical material and are displaced radially from a central axis of said electron gun, said radiation surface areas being differently inclined relative to said central axis to direct roentgen rays respectively through said exit windows, and programmed means for shifting said continuous electron beam sequentially from one radiation surface area to another to direct roentgen rays successively through said exit windows and onto said substrates respectively, said beam shifting means comprising first and second pairs of electron beam deflection plates disposed perpendicular to one another about the path of said electron beam and circuitry for applying selected voltages to said deflection plate pairs, said circuitry comprising a source of a plurality of different voltages, gate means for selectively applying selected voltages from said source to said deflection plate pairs respectively to direct said continuous electron beam sequentially to selected radiation surface areas, said control circuit means including programmed timing means for controlling said gate means to cause said continuous electron beam to be displaced angularly relative to said central axis and to fall successively on said radiation surface areas of said target under a target angle of from 0° to 10° in predetermined repeated sequence with a dwell for a predetermined period of time on each radiation surface area and rapid shifting from one radiation surface area to another, the dwell time on each radiation surface area being sufficiently long to provide adequate exposure of said substrates and sufficiently short to avoid damage to said target by said sharply focused electron beam.

2. Roentgen lithography apparatus according to claim 1, in which said target angle is approximately 5.5°.

3. Roentgen lithography apparatus according to claim 1, in which a surface of said target facing said electron gun is dome shaped with a zenith on said central axis and in which said radiation surface areas are disposed around and are radially spaced from said zenith.

4. Roentgen lithography apparatus according to claim 1, in which a surface of said target facing said electron gun has a plurality of differently inclined plane radiation surface areas disposed around and spaced radially from said central axis.

5. Roentgen lithography apparatus according to claim 1, in which said grid has an internally threaded bore rearwardly of said annular flange and in which said glow cathode is mounted on an externally threaded member screwed into said threaded bore, the position of said glow cathode relative to said flange being variable by rotation of said threaded member relative to said grid.

6. Roentgen lithography apparatus according to claim 5, in which an outer conical surface of said flange and an inner surface of said flange of said grid converge in a peripehral edge of said central opening, said edge being approximately semicircular in cross section with a small radius of curvature.

7. Roentgen lithography apparatus according to claim 1, in which said timing means comprises a bistable multivibrator.

8. A method of producing copies of an original by roentgen lithography with apparatus comprising an electron gun having a glow cathode and a grid, electron beam deflecting and focussing means for producing a sharply focused continuous electron beam, a stationary target on which said electron beam is directed, a plurality of exit windows arranged around said target through which roentgen rays produced on said target are projected, said target having a plurality of radiation surface areas which are all of identical material and are displaced radially from a central axis of said electron gun and target and positioned to direct roentgen rays through said exit windows respectively, a plurality of substrate holders arranged around said roentgen gun for holding substrates in position to receive roentgen rays emitted through said exit windows respectively and a like plurality of mask holders for holding lithographic masks in front of said substrates respectively, means for shifting said continuous electron beam sequentially from one radiation surface area to another to direct roentgen rays successively through said exit windows and onto said substrates respectively, said shifting means comprising first and second pairs of electron beam deflection plates disposed perpendicular to one another about the path of said electron beam and circuitry for applying selected voltages to said deflection plates pairs, said circuitry comprising a source of a plurality of different voltages, gate means for selectively applying selected voltages from said source to said deflection plate pairs respectively to direct said continuous electron beam to selected surface areas and means for controlling said gate means, said method comprising operating and controlling said gate means to apply selected voltages sequentially to said deflection plates to direct said sharply focused continuous electron beam sequentially on said radiation surface areas to produce roentgen radiation directed out through respective exit windows under a target angle of from 0° to 10°, said gate means being operated to cause said electron beam to dwell for a predetermined period of time on each radiation surface area and then shift rapidly to another radiation surface area, the dwell time on each radiation surface area being sufficiently short to avoid damage to said target, said substrates being illuminated sequentially by roentgen rays exiting from respective windows, and removing exposed substrates and replacing them by unexposed substrates while said electron beam is not directed to respective radiation surface areas.

9. A method according to claim 8, in which the sequence of directing said electron beam on said radiation surface area is repeated while said substrates remain on said substrate holders to subject said substrates to repeated intermittent radiation by said roentgen rays.

10. Roentgen lithography apparatus comprising a roentgen tube for producing long wave roentgen radiation comprising an electron gun having a glow cathode and a grid, electron beam deflecting and focusing means for producing a continuous electron beam, a stationary target on which said electron beam is directed, and a plurality of exit windows around said target through which roentgen rays produced on said target are projected, said target having a plurality of radiation surface areas which are all of identical material and are displaced radially from a central axis of said electron gun and target, each of said radiation surface areas being positioned to direct roentgen rays solely through a respective exit windows, said electron beam deflecting and focussing means comprising means for directing a sharply focused high intensity electron beam sequentially on said radiation surface areas with a focal spot on said target having a diameter less than $10^{-4}$ m. to produce roentgen radiation directed sequentially out through respective exit windows, a plurality of substrate holders arranged around said roentgen tube for holding substrates in position to receive roentgen rays emitted through said exit windows respectively, and a like plurality of mask holders for holding lithographic masks in front of said substrates respectively, said masks and respective substrates being illuminated sequentially by said reentgen rays, said electron beam deflecting and focussing means operating to cause said continuous electron beam to be displaced angularly relative to said central axis and to fall successively on said radiation surface areas of said target under a target angle of from 0° to 10° with a dwell for a predetermined period of time on each radiation surface area and rapid shifting from one radiation surface area to another, the dwell time on each radiation surface area being sufficiently long to provide adequate exposure of said substrate and sufficiently short to avoid damage to said target, said deflection and focussing means comprising first and second pairs of electron beam deflection plates disposed perpendicularly to one another about the path of said electron beam and circuitry to apply selected voltages to said deflection plate pairs, said circuitry comprising a source of a plurality of different voltages, gate means for selectively applying selected voltages from said source to said deflection plate pairs respectively to direct said continuous electron beam to selected radiation surface areas and control circuit means including programmed timing means for controlling said gate means to rapidly shift said continuous electron beam sequentially from one to another of said radiation surface areas in predetermined repeated sequence with a predetermined dwell time on each radiation surface area.

11. Roentgen lithography apparatus according to claim 10, in which a surface of said target facing said electron gun is dome shaped with a zenith on said central axis and with said radiation surface areas disposed around and spaced radially from said zenith.

12. Roentgen lithography apparatus according to claim 10, in which a surface of said target facing said electron gun has a plurality of differently inclined plane radiation surface areas disposed around and spaced radially from said central axis.

13. Roentgen lithography apparatus according to claim 10, further comprising radially disposed shields between adjacent exit windows to prevent roentgen rays directed toward one exit window straying to an adjacent exit window.

14. Roentgen lithography apparatus according to claim 10, in which said radiation surface areas are so disposed relatively to said electron beam when deflected to be directed to a respective radiation surface area that target angle is approximately 5.5°.

* * * * *